US006622661B1

(12) United States Patent
Hotton

(10) Patent No.: US 6,622,661 B1
(45) Date of Patent: Sep. 23, 2003

(54) FUEL-FIRED HEATING APPLIANCE WITH DILUTION AIR/FLAMMABLE VAPOR BYPASS TUBE AND ELEVATED COMBUSTION AIR INLET

(75) Inventor: Bruce A. Hotton, Montgomery, AL (US)

(73) Assignee: The Water Heater Industry Joint Research and Development Consortium, Rio Verde, AZ (US)

( * ) Notice: Subject to any disclaimer, the term of this patent is extended or adjusted under 35 U.S.C. 154(b) by 0 days.

(21) Appl. No.: 10/345,592

(22) Filed: Jan. 16, 2003

(51) Int. Cl.[7] ..... F22B 5/00

(52) U.S. Cl. ..... 122/13.01; 122/18.31; 122/504

(58) Field of Search ..... 122/13.01, 17.1, 122/17.2, 18.3, 18.31, 504

(56) References Cited

U.S. PATENT DOCUMENTS

| | | | | |
|---|---|---|---|---|
| 58,159 | A | 9/1866 | Wilder | |
| 771,680 | A | 10/1904 | Stocking | |
| 849,346 | A | 4/1907 | Abbott | |
| 1,054,688 | A | 3/1913 | Harr | |
| 1,967,128 | A | 7/1934 | Moser | 126/312 |
| 4,940,042 | A | 7/1990 | Moore, Jr. et al. | 126/344 |
| 5,085,205 | A | 2/1992 | Hall et al. | 126/363 |
| 5,191,874 | A | 3/1993 | McWilliams | 126/312 |
| 5,255,665 | A | 10/1993 | Windon | 126/389 |
| 5,341,767 | A | 8/1994 | Smith | 122/14 |
| 5,697,330 | A | 12/1997 | Yetman et al. | 122/13.1 |
| 5,848,586 | A | 12/1998 | Garms | 126/361 |
| 5,941,230 | A | 8/1999 | Rutz et al. | 126/80 |
| 6,058,892 | A | 5/2000 | Haack, II | 122/504 |
| 6,390,028 | B1 | 5/2002 | Langmead et al. | 122/14.2 |
| 6,412,447 | B1 | 7/2002 | Trant et al. | 122/14.1 |
| 2002/0124322 | A1 | 9/2002 | Dolan | |
| 2002/0134320 | A1 | 9/2002 | Valcic et al. | |

FOREIGN PATENT DOCUMENTS

| | | |
|---|---|---|
| WO | WO 00/06947 | 2/2000 |

*Primary Examiner*—Jiping Lu
(74) *Attorney, Agent, or Firm*—Konneker & Smith, P.C.

(57) ABSTRACT

A fuel-fired heating apparatus, representatively a forced draft or natural draft gas-fired water heater having a combustion chamber, is provided with a flammable vapor control system that functions, during firing of the apparatus, to substantially prevent entry into and combustion within the combustion chamber of extraneous flammable vapors externally adjacent the bottom of the apparatus, without detecting the extraneous flammable vapors or terminating firing of the apparatus. The flammable vapor control system includes a dilution air flow passage connected to a discharge portion of the apparatus vent structure and having an inlet externally adjacent a bottom portion of the apparatus and operative to draw dilution air and extraneous flammable vapors into the vent structure discharge portion, and a combustion air flow passage having an inlet disposed adjacent the upper end of the apparatus, and an outlet communicated with the interior of the combustion chamber.

33 Claims, 1 Drawing Sheet

FUEL-FIRED HEATING APPLIANCE WITH DILUTION AIR/FLAMMABLE VAPOR BYPASS TUBE AND ELEVATED COMBUSTION AIR INLET

BACKGROUND OF THE INVENTION

The present invention generally relates to fuel-fired heating appliances and, in a preferred embodiment thereof, more particularly provides a gas-fired, forced draft water heater having incorporated therein a specially designed flammable vapor control system operative to substantially prevent entry into combustion within the water heater combustion chamber of extraneous flammable vapors externally adjacent a bottom portion of the water heater without detecting extraneous flammable vapors or terminating firing of the water heater.

Gas-fired residential and commercial water heaters are generally formed to include a vertical cylindrical water storage tank with a gas burner disposed within a combustion chamber below the tank. The burner is supplied with fuel gas through a valved gas supply line, and combustion air through an air inlet flow path providing communication between the exterior of the water heater and the interior of the combustion chamber.

Water heaters of this general type are extremely safe and quite reliable in operation. However, when gasoline or other flammable liquids are stored or used improperly in proximity to the water heater, there may exist a possibility of extraneous flammable vapors externally adjacent a lower end portion of the water heater becoming entrained in the air intake of the water. It is theorized that such vapors might cause secondary combustion to occur within the confines of the water heater combustion chamber.

Various proposals have recently been made to prevent extraneous flammable vapors from entering a water heater combustion chamber and becoming ignited therein. Such proposals typically entail disposing a flammable vapor sensor for impingement by extraneous flammable vapors, and shutting down firing of the water heater, either by terminating fuel flow or combustion air flow to the water heater, in response to the sensor's detection of flammable vapors.

These previous proposals are typically incorporated in conjunction with a flame arrestor plate forming a bottom exterior wall of the combustion chamber and having a series of "flame quenching" openings therein which permit flammable vapors to enter the combustion chamber, but prevent combustion chamber flames from passing outwardly through such openings.

Flammable vapor sensors, like most electrical components, are subject to failure and, if their sensitivities are not carefully adjusted, may cause "nuisance" tripping of the safety system in a manner unnecessarily terminating or preventing firing of the water heater. Additionally, perforated flame arrestor plates may be prone to clogging with lint in certain operating environments, thereby undesirably reducing the combustion efficiency of the water heater.

As can be seen from the foregoing, it would be desirable to provide a fuel-fired heating appliance, such as a gas-fired water heater, with a flammable vapor control system for substantially preventing entry into and combustion within the combustion chamber of extraneous flammable vapors externally adjacent a bottom portion of the appliance, without the use of a flammable vapor sensor or a flame arrestor, and without terminating the firing of the appliance when it is exposed to external extraneous flammable vapors.

SUMMARY OF THE INVENTION

In carrying out principles of the present invention, in accordance with a preferred embodiment thereof, a fuel-fired heating apparatus, representatively a gas-fired water heater, is provided which has top and bottom portions and comprises a combustion chamber at its bottom portion, a burner structure operative to create hot combustion products within the combustion chamber, and a vent structure having an inlet portion communicated with the combustion chamber, and a discharge portion disposed adjacent the top portion of the water heater. The vent structure is operative, during firing of the water heater, to create a draft that draws the created hot combustion products through the vent structure toward the discharge portion thereof. While the invention is representatively embodied in a fuel-fired water heater, it may alternatively be embodied in another type of fuel-fired heating appliance such as, for example, a boiler, air heating furnace or the like.

In one illustrative version thereof, the vent structure is a forced draft vent structure including a flue extending upwardly from the combustion chamber, through water stored in a tank portion of the water heater, and a draft inducer fan connected to an upper end portion of the flue and forming part of the discharge portion of the vent structure, In another illustrative version thereof, the vent structure is a natural draft vent structure in which the draft inducer fan is eliminated and replaced with an upward extension of the flue.

According to a key aspect of the present invention, the water heater (or other type of fuel-fired heating apparatus as the case may be) in either of its forced draft and natural draft versions is provided with a specially designed flammable vapor control system which, during operational firing of the water heater, functions to substantially prevent entry into and combustion within the water heater's combustion chamber of extraneous flammable vapors externally adjacent the bottom portion of the water heater, emanating for example from a flammable liquid spill on a floor area near the water heater, without detecting the extraneous flammable vapors or terminating the firing of the water heater.

In a representative embodiment thereof the flammable vapor control system includes a dilution air flow passage coupled to the discharge portion of the vent structure, isolated from direct communication with the combustion chamber, and having an inlet portion positioned externally adjacent the bottom portion of the water heater. The dilution air flow passage is representatively defined by an external conduit structure and functions, during firing of the water heater, to draw both dilution air and the extraneous flammable vapors upwardly from exteriorly adjacent the bottom portion of the water heater into the discharge portion of the vent structure for discharge therefrom.

The flammable vapor control system also includes a combustion air flow passage representatively defined by a combustion air inlet duct having an inlet disposed in an elevated relationship with the bottom portion of the water heater, preferably at its top portion, and an outlet which is preferably directly communicated with the interior of the combustion chamber. During operational firing of the water heater, the combination of (1) the dilution air inlet being positioned adjacent the floor near the bottom portion of the water heater, and thus in effect "vacuuming up" nearby flammable vapors, and (2) the combustion air duct inlet being adjacent the top portion of the water heater, serves to preclude entry of the flammable vapors into and combustion within the combustion chamber without either detecting the flammable vapors, for example by employing a flammable vapor sensor, or terminating firing of the water heater or other type of fuel-fired heating apparatus, for example by terminating combustion air flow and/or fuel flow thereto.

Preferably, all of the combustion air delivered to the combustion chamber interiorly traverses the combustion air inlet duct which is directly coupled to the combustion chamber for delivery of ambient combustion air thereinto. Accordingly, in a preferred embodiment of the water heater the bounding wall structure of its combustion chamber is devoid of flame quenching inlet openings which might tend to become clogged during the operational life of the water heater.

DETAILED DESCRIPTION

Figure 1:
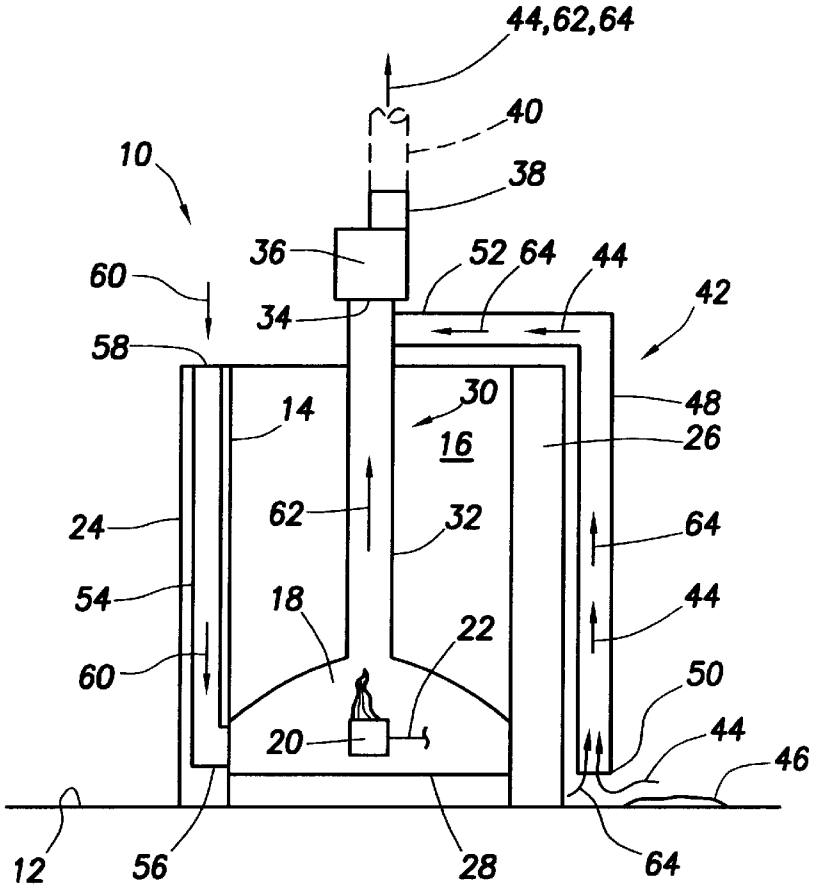
FIG. 1 is a schematic cross-sectional view through a gas-fired, forced draft water heater incorporating therein a specially designed flammable vapor control system embodying principles of the present invention.

As cross-sectionally illustrated in schematic form in FIG. 1, the present invention provides a fuel-fired heating appliance which is representatively in the form of a forced draft, gas-fired water heater 10. Alternatively, the water heater 10 could be another type of fuel-fired heating apparatus, of either a forced draft or natural draft type, such as, for example, a boiler or an air heating furnace.

Water heater 10 rests upon a floor 12 and has a tank 14 in which a quantity of heated water 16 is stored for on-demand delivery to hot water-utilizing plumbing fixtures such as sinks, showers, bathtubs, dishwashers and the like. At a lower end portion of the water heater 10 a combustion chamber 18 is located beneath the tank 14, the combustion chamber 18 having a gas burner structure 20 operationally disposed therein and supplied with gaseous fuel via a gas supply line 22. Tank 14 is disposed within a metal jacket 24 that defines an insulation cavity 26 Which is filled with a suitable insulation material (not shown) and outwardly circumscribes the tank 14. The combustion chamber 18 is defined by and enclosed within a wall structure representatively devoid of flame quenching inlet openings and including a substantially imperforate bottom wall 28.

Coupled to the combustion chamber 18 is a vent structure, generally denoted by the reference numeral 30, which includes a flue 32 communicated at its lower end with an upper side portion of the combustion chamber 18 and upwardly extending centrally through the interior of the tank 14. At its upper end, the flue is connected to the inlet 34 of a draft inducer fan 36 disposed atop the upper end of the water heater 10 and having an outlet 38 connected to a suitable vent pipe 40. An upper end portion of the flue 32, the draft inducer fan 36, and the vent pipe 40 define a discharge portion of the overall vent structure 30.

According to a key aspect of the present invention, the water heater 10 is provided with a specially designed flammable vapor control system 42 which, in a manner subsequently described herein, uniquely functions during firing or the water heater 10 to substantially prevent entry into and combustion within the combustion chamber 18 of extraneous flammable vapors 44 (emanating for example from a flammable liquid spill 46 on the floor 12 externally adjacent the bottom end of the water heater 10) without either (1) detecting the extraneous flammable vapors 44 or (2) terminating firing or the water heater 10. Moreover, the control of extraneous flammable vapors in the present invention is illustratively achieved without the provisions of flame quenching openings in the bounding wall structure of the combustion chamber 18.

In the embodiment thereof schematically depicted in FIG. 1, the flammable vapor control system 42 includes a dilution air flow passage illustratively defined by a dilution air conduit 48 externally extending along an outer side of the water heater 10 and having an inlet portion 50 disposed upwardly adjacent the floor 12 near the bottom of the water heater 10, and an outlet portion 52 coupled to the discharge portion of the vent structure 30 at the inlet 34 of the draft inducer fan 36. AS can be seen, the dilution air flow passage within the conduit 48 is isolated from direct communication with the interior of the combustion chamber 18, in effect bypassing the interior of the combustion chamber.

While the dilution air flow passage defined within the conduit 48 is representatively external to the balance of the water heater 10 it could alternatively be extended through various internal portions of the water heater 10, for example upwardly through the insulation cavity 26, if desired. Moreover, while the inlet portion 50 of the dilution air flow passage has been representatively illustrated as being a single bottom inlet opening of the conduit 48, it could alternatively be defined by an inlet opening having a different configuration, or a plurality of conduit inlet openings spaced around a bottom peripheral of the water heater 10, if desired, without departing from principles of the present invention.

The flammable vapor control system 42 also includes a combustion air flow passage representatively defined within the interior of a combustion air inlet duct 54 having an outlet 56 communicated with the interior of the combustion chamber 18, and an open inlet 58 which is elevated with respect to the bottom end portion of the water heater 10 and is preferably disposed at the top end of the water heater 10. Illustratively, the combustion air inlet duct 54 is extended upwardly through the insulation cavity 26, but could alternatively be external to the water heater 10 if desired.

During operational firing of the water heater 10, ambient combustion air 60 from adjacent the upper end of the water heater 10 is drawn downwardly through the combustion air inlet duct 54 into the combustion chamber 18 wherein the air 60 is mixed and combusted with fuel supplied to the burner structure 20 via the fuel supply pipe 22. The resulting hot combustion products 62 created within the combustion chamber 18 travel upwardly through the flue 32, such upward travel being assisted by the operation of the draft inducer fan 36, and transfer combustion heat to the tank water 16 through the side wall of the flue 32. At the same time, ambient dilution air 64 near the dilution air conduit inlet 50 is drawn upwardly through the dilution air conduit 48 into the inlet 34 of the draft inducer fan 36 for mixture with and cooling of the hot combustion products 62 being flowed upwardly through the fan 36.

When a flammable liquid spill, such as the illustrated spill 46, is present near the bottom end of the water heater 10 the draft inducer fan-created negative pressure at the inlet 50 of the dilution air conduit 48 draws the flammable vapors 44 adjacent the floor 12 upwardly into the conduit 48 for forced upward flow therethrough, with the dilution air 64, to the inlet 34 of the draft inducer fan 36. The operation of the draft inducer fan 36 thus, in effect, "vacuums" an area of the floor 12 adjacent the bottom end of the water heater 10 to entrain flammable vapors 44 prior to their migration to the inlet 58 of the combustion air inlet duct 54, the elevation of which further inhibits ingestion of flammable vapors 44 into the combustion air supply for the water heater 10. AS schematically indicated in FIG. 1, during firing of the water heater 10 the hot combustion products 62, the dilution air 64, and the flammable vapors 44 (if present) are discharged from the draft inducer fan 36 via the vent pipe 40.

Since all of the combustion air supplied to the combustion chamber 18 flows through the combustion air inlet duct 54, this substantially prevents any flammable vapors 44 from the flammable liquid floor spill 46 from entering and being combusted within the combustion chamber 18. Importantly, this preclusion of extraneous flammable vapor inflow to the combustion chamber 18 is achieved by the flammable vapor control system 42, as previously mentioned herein, without (1) the actual detection of the flammable vapors 44 (such as by the use of, for example, a flammable vapor sensor), or (2) terminating the firing of the water heater 10 such as by terminating further combustion air flow and/or fuel flow thereto.

Additionally, the unique combination of the elevated combustion air inlet 58 and the dilution air inlet 50 externally adjacent the bottom end of the water heater 10 permits the combustion chamber 18 to be constructed without the formation therein of flame quenching openings in any portion of its bounding wall structure, thereby eliminating the possibility of clogging of these small openings formed in the combustion chamber wall structures of previously proposed fuel-fired heating appliances incorporating other types of flammable vapor control systems.

Figure 2:
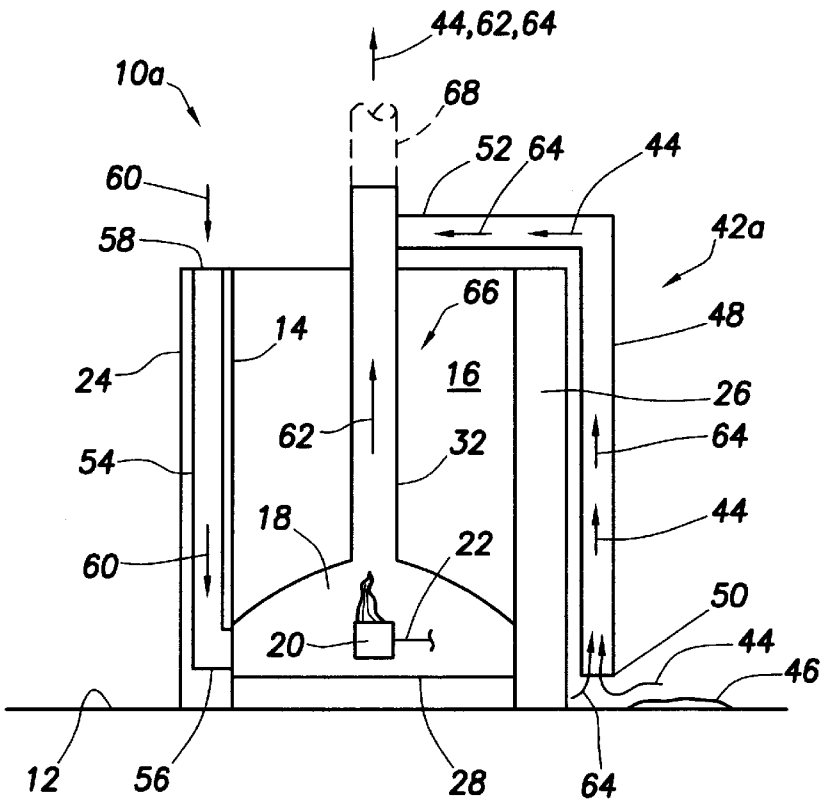
FIG. 2 is a schematic cross-sectional view through an alternate natural draft embodiment of the FIG. 1 water heater.

An alternate, natural draft embodiment 10*a* of the previously described fuel-fired forced draft water heater 10 is schematically depicted in FIG. 2. For ease in comparison between the two water heater embodiments 10 and 10*a*, similar components in the two embodiments have been given the same reference numerals.

Water heater 10*a* shown in FIG. 2 is identical to the FIG. 1 water heater 10 with the exceptions that it is provided with a natural draft vent structure 66 incorporated in a natural draft-based flammable vapor control system 42*a* instead of the previously described forced draft vent structure 30 and flammable vapor control system 42 incorporated in the water heater 10 of FIG. 1. In the natural draft vent structure 66 incorporated in the water heater 10*a*, the draft inducer fan 36 is eliminated, and an upper discharge end of the flue 32 is coupled to a suitable vent pipe 68.

During operational firing of the water heater 10*a* in the presence of flammable vapors 44 from a flammable liquid spill 46 on the floor 12 adjacent the bottom end of the water heater 10*a*, the natural draft of the vent structure 66 draws ambient combustion air 60 downwardly into the combustion chamber 18 via the duct 54, while at the same time drawing dilution air 64 and flammable vapors 44 upwardly through the dilution air conduit 48 for discharge through the vent pipe 68 with the combustion products 62. Thus, using a natural draft mechanism as opposed to a forced draft mechanism, the flammable vapor control system 42*a* of the water heater 10*a* substantially prevents any flammable vapors 44 from the flammable liquid floor spill 46 from entering and being combusted within the combustion chamber 18, during firing of the water heater 10*a*, without the actual detection of the flammable vapors 44 or terminating the firing of the water heater 10*a* such as by terminating further combustion air flow and/or fuel flow thereto. Additionally, like the previously described water heater flammable vapor control system 42, the flammable vapor control system 42*a* permits the combustion chamber 18 to be constructed without the formation therein of flame quenching openings in any portion of its bounding wall structure, thereby eliminating the possibility of clogging of these small openings formed in the combustion chamber wall structures of previously proposed fuel-fired heating appliances incorporating other types of flammable vapor control systems.

The foregoing detailed description is to be clearly understood as being given by way of illustration and example only, the spirit and scope of the present invention being limited solely by the appended claims.

What is claimed is:

1. Fuel-fired heating apparatus having top and bottom portions and comprising:

a combustion chamber;

a burner structure operative to create hot combustion products within said combustion chamber;

a vent structure having an inlet portion communicated with said combustion chamber, and a discharge portion disposed adjacent said top portion of said heating apparatus, said vent structure being operative, during firing of said heating apparatus, to create a draft that draws the created hot combustion products through said vent structure toward said discharge portion thereof; and a flammable vapor control system for substantially preventing entry into and combustion within said combustion chamber of extraneous flammable vapors externally adjacent said bottom portion of said heating apparatus, without detecting the extraneous flammable vapors or terminating firing of said heating apparatus, said flammable vapor control system including:

a dilution air flow passage coupled to said discharge portion of said vent structure, isolated from direct communication with said combustion chamber, and having an inlet portion positioned externally adjacent said bottom portion of said heating apparatus, said dilution air flow passage functioning, during firing of said heating apparatus, to draw dilution air and said extraneous flammable vapors into said discharge portion of said vent structure for discharge therefrom, and a combustion air flow passage having an inlet disposed in an elevated relationship with said bottom portion of said heating apparatus, and an outlet communicated with said combustion chamber.

2. The fuel-fired heating apparatus of claim 1 wherein:

said outlet of said combustion air flow passage is directly connected to said combustion chamber.

3. The fuel-fired heating apparatus of claim 2 wherein:

substantially all of the combustion air supplied to said combustion chamber interiorly traverses said combustion air flow passage.

4. The fuel-fired heating apparatus of claim 1 wherein:

said heating apparatus is a fuel-fired water heater.

5. The fuel-fired heating apparatus of claim 1 wherein:

said heating apparatus is a gas-fired water heater.

6. The fuel-fired heating apparatus of claim 1 wherein:

said heating apparatus is a forced draft heating appliance, said discharge portion of said vent structure includes a draft inducer fan having an inlet portion, and said dilution air flow passage is coupled to said inlet portion of said draft inducer fan.

7. The fuel-fired heating apparatus of claim 6 wherein:

said dilution air flow passage is defined by an external conduit structure.

8. The fuel-fired heating apparatus of claim 1 wherein:

said heating apparatus is a natural draft heating appliance.

9. The fuel-fired heating apparatus of claim 8 wherein:

said dilution air flow passage is defined by an external conduit structure.

10. The fuel-fired heating apparatus of claim 1 wherein:

said inlet of said combustion air flow passage is disposed adjacent said top portion of said fuel-fired heating apparatus.

11. The fuel-fired heating apparatus of claim 1 wherein:

said combustion chamber has a substantially imperforate bottom wall.

12. The fuel-fired heating apparatus of claim 1 wherein:

said combustion chamber is enclosed within and bounded by a wall structure substantially devoid of flame quenching openings.

13. Fuel-fired heating apparatus a bottom portion and comprising:

a combustion chamber disposed at said bottom portion of said heating apparatus;

a burner structure operative to create hot combustion products within said combustion chamber;

a vent structure operative having an inlet portion communicated with said combustion chamber, and a discharge portion, said vent structure being operative, during firing of said heating apparatus, to create a draft that draws the created hot combustion products through said vent structure toward said discharge portion thereof; and a flammable vapor control system for substantially preventing entry into and combustion within said combustion chamber of extraneous flammable vapors externally adjacent said bottom portion of said heating apparatus, without detecting the extraneous flammable vapors or terminating firing of said heating apparatus, said flammable vapor control system including:

a dilution air flow passage coupled to said discharge portion of said vent structure, isolated from direct communication with said combustion chamber, and having an inlet portion positioned externally adjacent said bottom portion of said heating apparatus, said dilution air flow passage functioning, during firing of said heating apparatus, to draw dilution air and said extraneous flammable vapors into said discharge portion of said vent structure for discharge therefrom, and a combustion air flow passage having an inlet for receiving ambient combustion air from adjacent said heating apparatus, and an outlet communicated with said combustion chamber.

14. The fuel-fired heating apparatus of claim 13 wherein:

said outlet of said combustion air flow passage is directly connected to said combustion chamber.

15. The fuel-fired heating apparatus of claim 14 wherein:

substantially all of the combustion air supplied to said combustion chamber interiorly traverses said combustion air flow passage.

16. The fuel-fired heating apparatus of claim 13 wherein:

said heating apparatus is a fuel-fired water heater.

17. The fuel-fired heating apparatus of claim 13 wherein:

said heating apparatus is a gas-fired water heater.

18. The fuel-fired heating apparatus of claim 13 wherein:

said heating apparatus is a forced draft heating appliance, said discharge portion of said vent structure includes a draft inducer fan having an inlet portion, and said dilution air flow passage is coupled to said inlet portion of said draft inducer fan.

19. The fuel-fired heating apparatus of claim 18 wherein:

said dilution air flow passage is defined by an external conduit structure.

20. The fuel-fired heating apparatus of claim 13 wherein:

said heating apparatus is a natural draft heating appliance.

21. The fuel-fired heating apparatus of claim 20 wherein:

said dilution air flow passage is defined by an external conduit structure.

22. The fuel-fired heating apparatus of claim 13 wherein:

said combustion chamber has a substantially imperforate bottom wall.

23. The fuel-fired heating apparatus of claim 13 wherein:

said combustion chamber is enclosed within and bounded by a wall structure substantially devoid of flame quenching openings.

24. A method of operating a fuel-fired heating apparatus having a combustion chamber disposed at a bottom portion thereof, a burner structure operative to create hot combustion products within said combustion chamber, and a vent structure having an inlet portion communicated with said combustion chamber, and a discharge portion, said vent structure being operative, during firing of said heating apparatus, to create a draft that draws the created hot combustion products through said vent structure toward said discharge portion thereof, for discharge therefrom, said method comprising the step of:

substantially preventing entry into and combustion within said combustion chamber, during firing of said heating apparatus, of extraneous flammable vapors externally adjacent said bottom portion of said heating apparatus, without detecting the extraneous flammable vapors or terminating firing of said heating apparatus, said substantially preventing step including the steps of:

drawing dilution air and said extraneous flammable vapors into said discharge portion of said vent structure from a location externally adjacent said bottom portion of said heating appliance, during firing thereof, into said discharge portion of said vent structure via a dilution air flow path isolated from direct communication with said combustion chamber, and flowing ambient combustion air into said combustion chamber, from adjacent said heating apparatus, via a combustion air flow passage.

25. The method of claim 24 wherein:

said flowing step is performed using a combustion air flow passage having an inlet portion elevated relative to said bottom portion of said heating apparatus.

26. The method of claim 24 wherein:

said heating apparatus has a top portion, and said flowing step is performed using a combustion air flow passage having an inlet portion disposed adjacent said top portion of said heating apparatus.

27. The method of claim 24 wherein:

said combustion air flow passage is defined by a conduit structure having an outlet, and said flowing step includes the step of directly connecting said outlet to said combustion chamber.

28. The method of claim 27 wherein:

said flowing step is performed in a manner such that all of the combustion air supplied to said combustion chamber interiorly traverses said conduit structure.

29. The method of claim 24 wherein:

said heating apparatus is a forced draft heating appliance, said discharge portion of said vent structure includes a draft inducer fan having an inlet portion, and said drawing step is performed by drawing dilution air and said extraneous flammable vapors into said inlet portion of said draft inducer fan.

30. The method of claim 29 wherein:

said drawing step is performed using an external conduit structure.

31. The method of claim 24 wherein:

said heating apparatus is a natural draft heating appliance, and said drawing step is performed using a conduit structure coupled to said discharge portion of said vent structure.

32. The method of claim 24 further comprising the step of:

providing said combustion chamber with a substantially imperforate bottom wall.

33. The method of claim 24 further comprising the step of:

bounding said combustion chamber with a wall structure substantially devoid of flame quenching openings.

* * * * *

UNITED STATES PATENT AND TRADEMARK OFFICE

CERTIFICATE OF CORRECTION

PATENT NO. : 6,622,661 B1
DATED : September 23, 2003
INVENTOR(S) : Bruce A. Hotton It is certified that error appears in the above-identified patent and that said Letters Patent is hereby corrected as shown below:

Column 7,
Line 20, insert -- having -- between “apparatus” and “a”.

Signed and Sealed this

Thirtieth Day of December, 2003

JAMES E. ROGAN
*Director of the United States Patent and Trademark Office*